US005945821A

United States Patent [19]

Sakurai et al.

[11] Patent Number: 5,945,821

[45] Date of Patent: Aug. 31, 1999

[54] REFERENCE VOLTAGE GENERATING CIRCUIT

[75] Inventors: Yasuhiro Sakurai, Sayama; Hiroki Nishi, Asaka, both of Japan

[73] Assignee: Citizen Watch Co., Ltd., Tokyo, Japan

[21] Appl. No.: 09/054,414

[22] Filed: Apr. 3, 1998

[30] Foreign Application Priority Data

Apr. 4, 1997 [JP] Japan ..... 9-086180
Jun. 13, 1997 [JP] Japan ..... 9-156789

[51] Int. Cl.[6] ..... G05F 3/16; G05F 3/26

[52] U.S. Cl. ..... 323/313; 323/315; 323/907

[58] Field of Search ..... 323/313, 314, 323/315, 316, 907; 257/407

[56] References Cited

U.S. PATENT DOCUMENTS

| | | | |
|---|---|---|---|
| 5,410,242 | 4/1995 | Bittner | 323/315 |
| 5,598,095 | 1/1997 | Schnaitter | 323/315 |
| 5,726,563 | 3/1998 | Bolton, Jr. | 323/315 |
| 5,777,509 | 7/1998 | Gasparik | 327/542 |
| 5,798,669 | 8/1998 | Klughart | 327/539 |
| 5,818,294 | 10/1998 | Ashmore, Jr. | 323/315 |

FOREIGN PATENT DOCUMENTS 3-180915 8/1991 Japan .

*Primary Examiner*—Peter S. Wong
*Assistant Examiner*—Derek J. Jarden
*Attorney, Agent, or Firm*—Armstrong, Westerman, Hattori, McLeland & Naughton

[57] ABSTRACT

Between the higher-potential power supply and the lower-potential power supply, a pair of first conductivity type MOS transistors having same configurations except for mutually different work functions of the gate electrode and another pair of second conductivity type MOS transistors having the same properties are provided to constitute a differential amplifier. The drain of the other MOS transistor having the second conductivity type is connected to the output terminal and, at the same time, is connected to the higher-potential power supply via a resistor circuit, thereby connecting the gate of one of the above-mentioned pairs of MOS transistors with the first conductivity type to the intermediate point of the resistor circuit. With this, the differential amplifier outputs at its output terminal a voltage corresponding to a difference in gate work function of the pair of MOS transistors having the first conductivity type.

5 Claims, 3 Drawing Sheets

REFERENCE VOLTAGE GENERATING CIRCUIT

BACKGROUND OF THE INVENTION

1. Field of the Invention

The present invention relates to a reference-voltage generating circuit that supplies a constant reference voltage to electronic equipment components mounted on portable equipment susceptible to temperature changes or power supply voltage fluctuations.

2. Description of the Related Art

The electronic equipment components mounted on portable equipment such as a portable telephone or notebook-type personal computer are by nature largely susceptible to temperature changes or power voltage fluctuations. The portable telephone, for example, is required to be assured of normal operation against temperature changes of −30° C. to +90° C. Moreover, such portable equipment, which employs rechargeable batteries as its power supply, is required to operate in a stable manner against a certain extent of power voltage fluctuations.

To improve the accuracy and the performance of electronic equipment components mounted on such portable equipment against temperature changes and power voltage fluctuations, it is necessary to regulate voltage with which the internal circuits of those components are driven, and against temperature changes or power voltage fluctuations.

For this purpose, a constant-voltage generating circuit (regulator circuit) which regulates the drive voltage needs to have a reference-voltage generating circuit which generates a reference voltage to keep the regulation output potential at a constant level.

That is, for the internal circuits of an electronic equipment component to operate in a stable manner against temperature changes or power voltage fluctuations, it is necessary to provide an invariable value of voltage which is supplied by the constant-voltage generating circuit in order to drive those internal circuits.

The constant-voltage generating circuit in general is used in combination with a reference-voltage generating circuit, which supplies a reference potential for the potential regulation. An example of such combination of reference-voltage generating circuit and constant-voltage generating circuit is disclosed in Japanese Patent Laid-Open Publication No. 3-180915.

Generally, the internal circuits of electronic-equipment components are made up of semiconductor ICs and, more specifically, those reference-voltage generating circuits and constant-voltage generating circuits are composed of analog circuits which are made up of discrete MOS transistors. In these circuits, the voltage at which a discrete MOS transistor changes from the ON state to the OFF state is called the threshold voltage of that transistor and stays the same even for the opposite transition of state (i.e. change from the OFF state to the ON state). The current threshold voltage for typical MOS transistors used in logic circuits is approximately 0.7V.

FIG. 5 shows a circuit diagram of a prior-art reference-voltage generating circuit as disclosed in Laid-Open Publication 3-180915.

First, the following describes the configuration of a prior-art reference-voltage generating circuit with reference to FIG. 5.

In this reference-voltage generating circuit, the sources of all of three p-channel MOS transistors MP1, MP2, and MP3 are connected to a higher-potential power supply VDD. Note here that in FIG. 5, the gate, the source, and the drain of the MOS transistors are represented by G, S, and D respectively.

The gate of the p-channel MOS transistor MP1 is connected to the gate and the drain of the p-channel MOS transistor MP2; the drain of the p-channel MOS transistor MP1 is connected to the drain of an n-channel MOS transistor MN1; and the drain of the p-channel MOS transistor MP2 is connected to the drain of an n-channel MOS transistor MN2.

Moreover, the sources of both the n-channel MOS transistors MN1 and MN2 are connected to ground (earth) GND through a first constant-current circuit IC1.

Further, the p-channel MOS transistors MP1 and MP2, the n-channel MOS transistors MN1 and MN2, and the first constant-current circuit IC1 make up a differential amplifier OPA.

The drain of the n-channel MOS transistor MN1 is connected to both the gate of the p-channel MOS transistor MP3 and one terminal of a phase-compensation capacitor PC1. The drain of p-channel MOS transistor MP3 is in turn connected to the other terminal of the phase-compensation capacitor PC1 and also to GND through a second constant-current circuit IC2.

With this, the p-channel MOS transistor MP3, the phase-compensation capacitor PC1, and the second constant-current circuit IC2 constitute an output circuit OC1, providing its output terminal OUT at the drain of the p-channel MOS transistor MP3.

Further, between the output terminal OUT and GND, three resistors R1, R2, and R3 are connected in series; the gate of the n-channel MOS transistor MN1 is connected to the connection between resistors R2 and R3; and the gate of the n-channel MOS transistor MN2 is connected to the connection between resistors R1 and R2, thus making up a reference-voltage generating circuit.

The following explains how this prior-art reference-voltage generating circuit operates.

The serial circuit made up of the resistors R1, R2, and R3 provides a feedback to the gates of both the first and the second n-channel MOS transistors MN1 and MN2.

With this, the serial circuit of the resistors R1, R2, and R3 amplifies an offset voltage, which is a difference (VGS2−VGS1) between VGS1, i.e. the gate-source voltage of the n-channel MOS transistor MN1 and VGS2, i.e. the gate-source voltage of the n-channel MOS transistor MN2.

Therefore, the output voltage VOUT appearing at the output terminal OUT is as follows:

$$\mathrm{VOUT}=(\mathrm{VGS2}-\mathrm{VGS1})\times(R1+R2+R3)/R2 \quad (1)$$

Representing here the threshold voltages of the n-channel MOS transistors MN1 and MN2 and the drain currents flowing through them by VTH1, VTH2, I1, and I2, respectively, the following equations (2) and (3) are obtained based on the saturation equation for MOS transistors:

$$I1=K1\times(\mathrm{VGS1}-\mathrm{VTH1})2 \quad (2)$$

$$I2=K2\times(\mathrm{VGS2}-\mathrm{VTH2})2 \quad (3)$$

where K1 and K2 are conductivity coefficients.

If, here, the conductivity coefficients K1 and K2 of n-channel MOS transistors MN1 and MN2 as well as the conductivity coefficients and also the threshold voltages of the p-channel MOS transistors are designed to be equal to each other, respectively, k1=k2 and I1=I2 are obtained, thereby giving the following equation based on the above-mentioned equations (2) and (3):

$$VGS2-VGS1=VTH2-VTH1 \quad (4)$$

where VGS2−VGS1 is an offset voltage, which is equal to VTH2−VTH1, i.e. a difference in threshold voltage between the n-channel MOS transistors MN1 and MN2. The temperature characteristics of the threshold level of the same conductivity type of MOS transistors are almost the same, so that a reference voltage VREF of good temperature characteristic can be obtained as indicated by the following equation (5):

$$VREF=VTH2-VTH1 \quad (5)$$

Therefore, by substituting Equations (4) and (5) into Equation (1), it is possible to obtain an output voltage VOUT given in the following equation (6) having good temperature characteristics and being independent of power-supply voltage fluctuations:

$$VOUT=VREF\times(R1+R2+R3)/R2 \quad (6)$$

The resistors R1 and R2 in this case may well be 0Ω in value.

Also, the offset voltage may be output by employing n-channel MOS transistors MN1 and MN2 that have mutually different threshold voltages; by employing such p-channel MOS transistors MP1 and MP2 that have mutually different threshold voltages; or by constituting the MOS transistors in such a way as to be of the same conductivity type, but of different sizes.

The first constant-current circuit IC1 here keeps at a constant level a current following through the differential amplifier OPA, which current is divided into two equals by a so-called "current mirror circuit" constituted by the two p-channel MOS transistors MP1 and MP2.

With this, independently of power-supply voltage fluctuations or temperature changes, the same magnitude of drain-source current will flow through both p-channel MOS transistors MP1 and MP2.

Again, the gate of the p-channel MOS transistor MP1 is connected to the gate and the drain of the p-channel MOS transistor MP2.

Therefore, the same value of gate-source voltage is applied to both p-channel MOS transistors MP1 and MP2.

As can be seen from the VDS (drain-source voltage) vs. IDS (drain-source current) relationship, therefore, the operational amplifier OPA is stable when the drain-source voltage is equal for the p-channel MOS transistors MP1 and MP2 and, at the same time, the drain-source voltage is equal for the n-channel MOS transistors MN1 and MN2.

The VDS vs. ISD characteristics curve for n-channel MOS transistors is shown in FIG. 6.

In FIG. 6, the horizontal axis represents VDS (drain-source voltage) and the vertical axis, IDS (drain-source current). The same value of current flowing through both p-channel MOS transistors MP1 and MP2 is indicated by the dash-and-dot line IDP.

Again, the reference-voltage generating circuit shown in FIG. 5 has three resistors R1, R2, and R3 connected in series between the ground GND and the output terminal OUT of the output circuit.

With this configuration, the gate-source voltage of the n-channel MOS transistor MN1 is always closer in value to the GND potential than that of the n-channel MOS transistor MN2.

In this case, in FIG. 6 showing the VDS vs. IDS characteristics curve, the gate-source voltage of the n-channel MOS transistor MN1 is expressed by the curve VG1 and that of the n-channel MOS transistor MN2, by the curve VG2. The intersection of curve VG1 and dash-and-dot line IDP showing the same current flowing both the p-channel MOS transistors MP1 and MP2 indicates a drain-source voltage VD1 of the n-channel MOS transistor MN1, while the intersection of dash-and-dot line IDP and VG2 indicates a drain-source voltage VD2 of the n-channel MOS transistor MN2.

With this, for the differential amplifier OPA to be stable in operation, it is necessary that the drain-source voltage VD1 of the n-channel MOS transistor MN1 and the drain-source voltage VD2 of the n-channel MOS transistor MN2 be equal to each other.

Also, since the drain-source voltage VD1 of the n-channel MOS transistor MN1 is applied to the gate of the p-channel MOS transistor MP3, the drain-source voltage VD1 of the n-channel MOS transistor MN1 is higher in valve than the drain-source voltage VD2 of the n-channel MOS transistor MN2 and, at the same time, the drain potential of the p-channel MOS transistor MP3 gets closer in value to the GND potential.

However, the reference-voltage generating circuit shown in FIG. 5 has resistors R1, R2, and R3 connected in series between the GND terminal and the output terminal OUT of the output circuit OC1, so that some difference in potential always appears between the gate of the n-channel MOS transistor MN1 and that of the other n-channel MOS transistor MN2. Therefore, the differential amplifier OPA is stable only when the gate potential of the n-channel MOS transistor MN1 and that of the n-channel MOS transistor MN2 are both equal to the GND potential.

That is, the differential amplifier is stable only when the output voltage VOUT appearing at the output terminal OUT is equal to the potential of the GND terminal.

This means that based on the operation principle of the comparator circuit utilizing the configuration of the differential amplifier OPA, when mutually different potentials are applied at the two input terminals of the differential amplifier OPA, this amplifier outputs the potential of either the higher level power supply voltage or the lower level power supply voltage.

Also, even with such a reference-voltage generating circuit configuration as shown in FIG. 5, a desired level of output voltage VOUT will appear at the output terminal OUT when the p-channel MOS transistors MP1 and MP2 constituting a current-mirror circuit have mutually different threshold voltages or transistor dimensions or when, likewise, the n-channel MOS transistors MN1 and MN2 do so.

However, if the n-channel MOS transistors MN1 and MN2 have mutually different threshold voltages or if the p-channel MOS transistors MP1 and MP2 of the same conductivity type likewise do so, or have mutually different transistor dimensions, the temperature characteristics of these MOS transistors change.

The temperature characteristics of transistors change in general with, for example, the threshold voltage and the current density of drain-source currents flowing though channel regions, so that a plurality of transistors with mutually different threshold voltages have mutually different temperature characteristics.

Also, when transistors having different dimensions are employed, those transistors have mutually different current densities of the drain-source current flowing through their channel regions, with the current flowing through the differential amplifier OPA being constant due to the constant-current circuit IC1, so that those transistors have mutually different temperature characteristics.

With this, therefore, such transistors that have mutually different threshold voltages or transistor dimensions are employed to give rise to an offset voltage, thus enabling a desired level of output voltage VOUT which is stable against power supply voltage fluctuations even with the configuration of reference-voltage generating circuit shown in FIG. 5. In this case, however, this arrangement will be worsened in stability against temperature changes.

This is because if the p-channel MOS transistors MP1 and MP2 have mutually different threshold voltages or transistor dimensions, the drain-source current changes in a different manner between these two MOS transistors, so that it is impossible to keep the output voltage at a constant level.

Also, if the n-channel MOS transistors MN1 and MN2 have mutually different threshold voltages or transistor dimensions, those two MOS transistors have mutually different temperature characteristics, so that it is impossible to keep the output voltage VOUT constant.

In addition, if two transistors have mutually different transistor dimensions or threshold voltages, variations through the fabrication process have different influences on those transistors, bringing about large variations in the value of the output voltage VOUT.

SUMMARY OF THE INVENTION

In view of the above-mentioned problems, it is an object of the present invention to provide a reference-voltage generating circuit that generates a constant potential of output voltage which is stable against power-supply voltage fluctuations, temperature changes, and fabrication process variations.

To achieve this object, the present invention provides a reference-voltage generating circuit having the following configuration.

That is, the reference-voltage generating circuit according to the present invention comprises a first and a second power supply having mutually different supply voltages; a first and a second MOS transistor of a first conductivity type; a third, a fourth, and a fifth MOS transistor of a second conductivity type; a resistor circuit; and an output terminal at which a reference voltage appears.

In this generator circuit, the gate, source, and bulk of the above-mentioned first MOS transistor and the source and bulk of the above-mentioned second MOS transistor are connected to the first power supply, while the drain of the first MOS transistor is connected to the drain of the above-mentioned third MOS transistor and the gate of the above-mentioned fifth MOS transistor.

In addition, the drain of the second MOS transistor is connected to the gate of the third MOS transistor and the gate and drain of the above-mentioned fourth MOS transistor, while the sources and the bulks of the third, fourth, and fifth MOS transistors are all connected to the above-mentioned second power supply.

Furthermore, the drain of the fifth MOS transistor is connected to the above-mentioned output terminal and also to the first power supply through the above-mentioned resistor circuit, thus connecting the gate of the second MOS transistor at the intermediate point of the resistor circuit.

The first and the second MOS transistors have substantially the same configuration except for mutually different values of work function of the gate material, while the third and the fourth MOS transistors have substantially the same properties.

If, in this reference-voltage generating circuit, the above-mentioned first and second MOS transistors of the first conductivity type are of the p-channel type and the third and fourth MOS transistors of the second conductivity type are of the n-channel type, the first MOS transistor must have a larger gate work function than the second MOS transistor.

For this purpose, the gate of the above-mentioned first MOS transistor should preferably be formed with high-concentration p-type silicon so that the Fermi level degenerates to the valence band, and the gate of the above-mentioned second MOS transistor should preferably be formed with high-concentration n-type silicon so that the Fermi level degenerates to the conduction band.

Also, if, in the earlier-mentioned reference-voltage generating circuit, the first and second MOS transistors of the first conductivity type are of the n-channel type and the third and fourth MOS transistors of the second conductivity type are of the p-channel type, the first MOS transistor must have a smaller gate work function than the second MOS transistor.

For this purpose, the gate of the first MOS transistor should preferably be formed with high-concentration n-type silicon so that the Fermi level degenerates to the conduction band, and the gate of the second MOS transistor should preferably be formed with high-concentration p-type silicon so that the Fermi level degenerates to the valence band.

In the reference-voltage generating circuit according to the present invention, the first and second MOS transistors of the first conductivity type and the third and fourth MOS transistors of the second conductivity type constitute a differential amplifier.

The first and the second MOS transistors of the same conductivity type constituting the input terminal of this differential amplifier have substantially the same configurations except for the gate material, so that these two MOS transistors have the same impurity concentration distribution of the channel region but different work functions of the gate electrode.

Therefore, the reference voltage to be output is always dependent on a difference in the work function between the two MOS transistors of the same conductivity type constituting the input terminal of this differential amplifier.

With this, the reference voltage output by the reference-voltage generating circuit according to the present invention is always stable, not being affected by power-supply voltage fluctuations, temperature changes, and fabrication process variations.

The above and other objects, features, and advantages of the invention will be apparent from the following detailed description which is to be read in conjunction with the accompanying drawings.

DETAILED DESCRIPTION OF THE PREFERRED EMBODIMENTS

The following describes the embodiments of the reference-voltage generating circuit according to the present invention.

Figure 1:
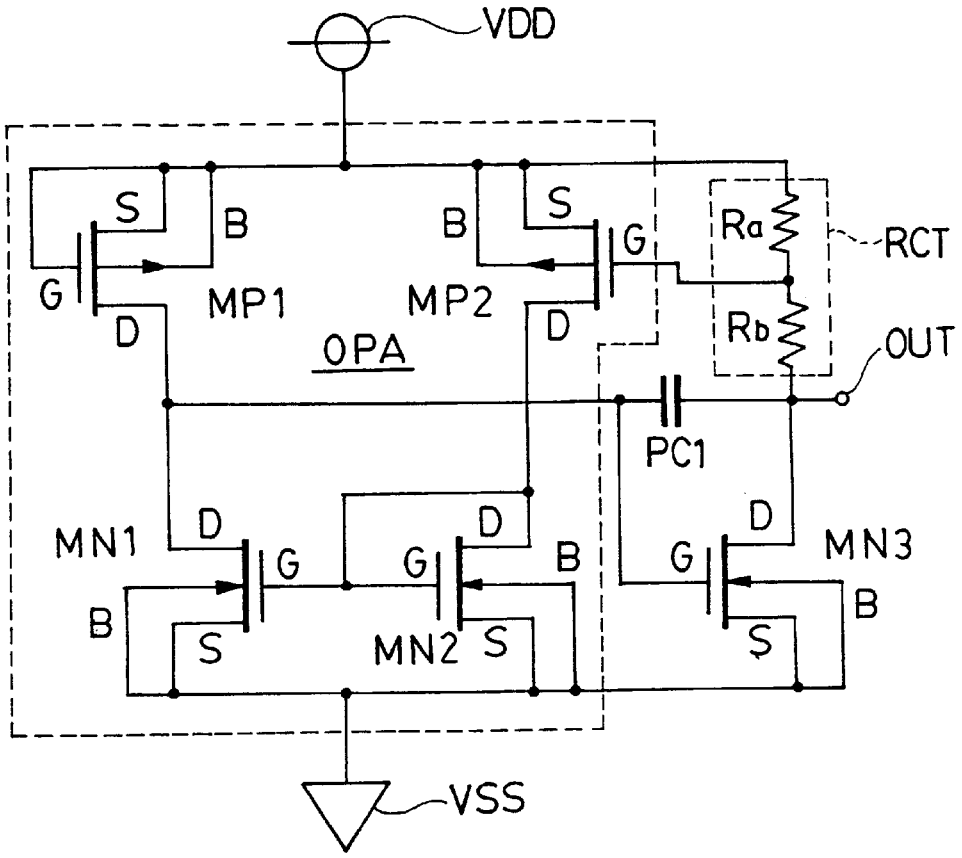
FIG. 1 is a circuit diagram showing the configuration of the reference-voltage generating circuit of the first embodiment of the present invention.
Figure 2:
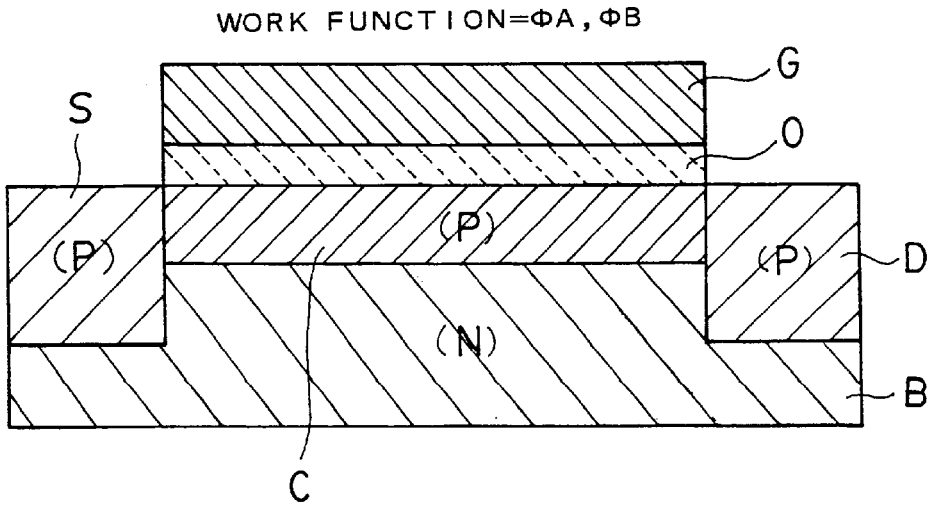
FIG. 2 is a schematic cross-sectional view showing the construction of p-channel MOS transistors used in the reference-voltage generating circuit of FIG. 1.

First Embodiment: FIGS. 1, 2

First, the first embodiment of the present invention will be described with reference to FIG. 1, which is the circuit diagram showing the configuration of the concerned reference-voltage generating circuit.

Figure 5:
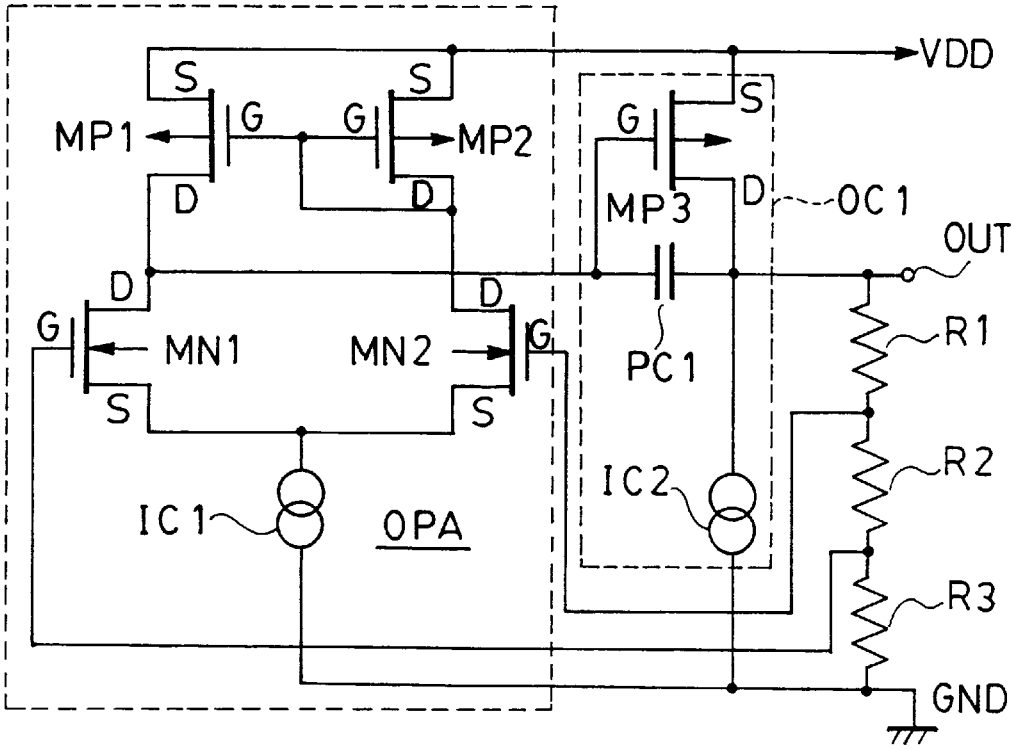
FIG. 5 PRIOR ART
FIG. 5 is a circuit diagram showing the construction of the prior-art reference-voltage generating circuit.
Figure 6:
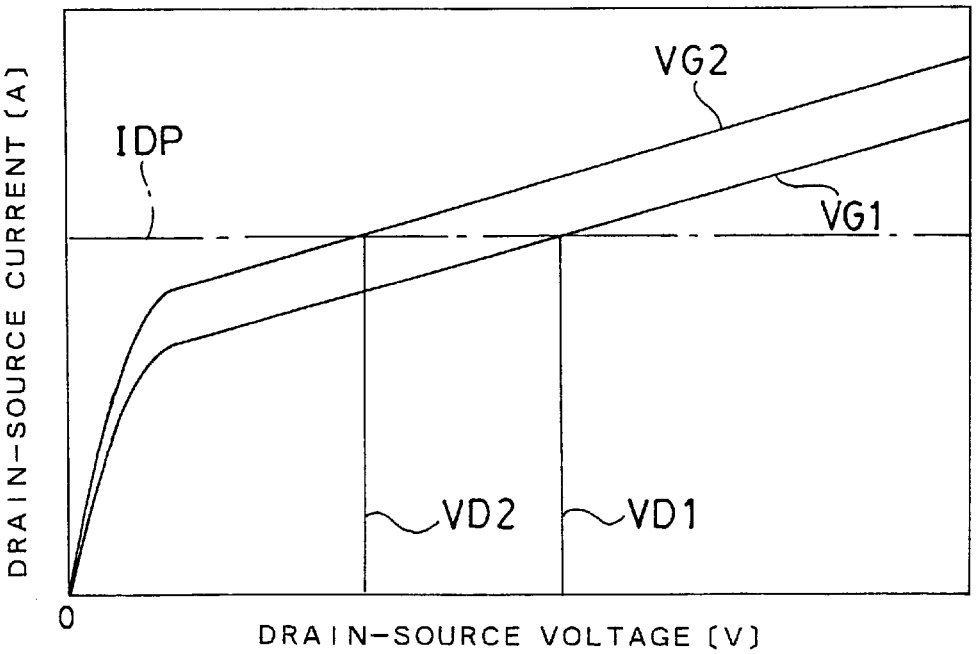
FIG. 6 PRIOR ART
FIG. 6 is a graph showing the VDS (drain-source voltage) vs. IDS (drain-source current) characteristics of n-channel MOS transistors.

In the reference-voltage generating of FIG. 1, the MOS transistors of the first conductivity type are p-channel type, while the MOS transistors of the second conductivity type are n-channel type. Although the same reference numerals are applied to the circuit elements corresponding to those of the prior-art reference-voltage generating circuit shown in FIG. 5, this does not mean that these elements are of the same configuration or properties.

Note here that in FIG. 1, gates, sources, drains, and bulks of the MOS transistors are represented by G, S, D, and B respectively.

The reference-voltage generating circuit of FIG. 1 comprises the first and higher-potential power supply VDD and the second and lower-potential power supply VSS; the first and second p-channel MOS transistors MP1 and MP2 of the first conductivity type; the third, fourth, and fifth n-channel MOS transistors MN1, MN2, and MN3 of the second conductivity type; a resistor circuit RCT consisting of resistors Ra and Rb connected in series; and an output terminal OUT at which a reference voltage is output.

The gate, source, and bulk of the p-channel MOS transistor MP1 and the source and bulk of the p-channel MOS transistor MP2 are connected to the higher-potential power supply VDD, while the drain of the p-channel MOS transistor MP1 is connected to the drain of the n-channel MOS transistor MN1 and the gate of the n-channel MOS transistor MN3.

Also, the drain of the p-channel MOS transistor MP2 is connected to the gate of the n-channel MOS transistor MN1 and the gate and drain of the n-channel MOS transistor MN2, while the sources and bulks of the n-channel MOS transistors MN1, MN2, and MN3 are all connected to the lower-potential power supply VSS.

Furthermore, the drain of the n-channel MOS transistor MN3 is connected to the output terminal OUT and also to the higher-potential power supply VDD via the resistor circuit RCT, connecting the gate of the p-channel MOS transistor MP2 to the intermediate point of the resistor circuit RCT. The n-channel MOS transistor MN3 has a phase compensation capacitor PC1 connected between its gate and drain. This capacitor PC1 is only provided for preventing oscillation and is not indispensable for the embodiments of the present invention.

Out of these elements, the pair of p-channel MOS transistors MP1 and MP2 and the other pair of n-channel MOS transistors MN1 and MN2 constitute a differential amplifier OPA.

The above-mentioned p-channel MOS transistors MP1 and MP2 have substantially the same configuration except for mutually different gate materials, while the above-mentioned n-channel MOS transistors MN1 and MN2 have substantially the same properties.

Next, the construction of the above-mentioned p-channel MOS transistors MP1 and MP2 will be described below.

FIG. 2 is a schematic cross-sectional view showing the construction of p-channel MOS transistors used as the first and second MOS transistors in the first embodiment.

Those p-channel MOS transistors have their bulk regions B formed with a low-concentration n-type semiconductor and they also have, in these bulk regions B, source regions S and drain regions D formed with a high-concentration p-type semiconductor. Between each source region S and each drain region D, a channel region C is formed with a low-concentration p-type semiconductor.

Also, those p-channel MOS transistors have their metal or semiconductor gates G formed above the channel regions C via insulators O, so that the gate electrodes G, the source regions S, the drain regions D, and the bulk regions B act as the gates, the sources, drains, and the bulks respectively.

The p-channel MOS transistors MP1 and MP2 shown in FIG. 1 have substantially the same configuration (including materials and dimensions) as well as substantially the same impurity concentration distribution of the channel distribution, except for mutually different materials of the gate electrode G shown in FIG. 2. By providing mutually different materials for the gate electrodes G, the gates electrodes have mutually different work functions.

Assuming here that the work function of the gate electrode G of the p-channel MOS transistor MP1 is $\Phi A$ and that of the p-channel MOS transistor MP2 is $\Phi B$, the materials of the gate electrodes G must be selected so that the work function $\Phi A$ is larger than the work function $\Phi B$.

The "work function" here refers to the height of the potential barrier beyond which an electron must jump at the surface of a substance in order to be emitted from it. That is, the work function means the work required to shift an electron from the Fermi level to a vacuum outside the solid, corresponding to the absolute value of the Fermi level energy with respect to the vacuum potential as measured to be zero.

Thus, to make the mutually different work functions at two gate electrodes G, it is necessary only to select and use two kinds of metals or semiconductors having different work functions. For example, aluminum or a refractory metal such as molybdenum and a high-concentration silicon can be selected in combination to provide mutually different work functions for the gate electrode.

Next, the following will explain the operation of the reference-voltage generating circuit.

The two n-channel MOS transistors, i.e. the third MOS transistor MN1 and the fourth MOS transistor MN2, constituting the current mirror circuit of the differential amplifier OPA divide the current flowing through this amplifier into two equal portions.

Therefore, the current flowing through the p-channel MOS transistor MP1 and the n-channel MOS transistor MN1 and the current flowing through the p-channel MOS transistor MP2 and the n-channel MOS transistor MN2 are always equal to each other.

The p-channel MOS transistors MP1 and MP2 should preferably be of the depletion type, such that a current may flow between the drain and the source even with the gate potential being zero. However, enhancement-type MOS transistors may also be used as far as even a slight current can flow between the drain and the source with the gate potential being zero.

Note here that since the p-channel MOS transistor MP1 employs a material having a work function $\Phi A$ as its gate electrode G, it has a corresponding threshold voltage.

Similarly, since the p-channel MOS transistor MP2 employs a material having a work function ΦB as its gate electrode G, it has a corresponding threshold voltage.

The difference between the threshold voltage of the p-channel MOS transistor MP1 and that of the p-channel MOS transistor MP2 is equal to the difference in work function of the gate electrode material between the p-channel MOS transistors MP1 and MP2.

Moreover, to provide a stable state of the differential amplifier OPA, the current flowing through the p-channel MOS transistor MP1 must be equal to the current flowing through the p-channel MOS transistor MP2.

In the reference-voltage generating circuit of the first embodiment of the present invention shown in FIG. 1, the gate of the p-channel MOS transistor MP1 is connected to the high-potential power supply VDD.

Therefore, the differential amplifier OPA will be stable only by applying to the gate of the p-channel MOS transistor MP2 the difference voltage between the threshold voltage of the p-channel MOS transistor MP1 and that of the p-channel MOS transistor MP2.

That is, the differential amplifier OPA will come into stability only by applying the feedback, from the output terminal of the differential amplifier OPA, to its input terminal, i.e. the gate of the p-channel MOS transistor MP2, a voltage difference between the work function ΦA of the gate electrode of the p-channel MOS transistor MP1 and the work function ΦB of the gate electrode of the p-channel MOS transistor MP2.

In the reference-voltage generating circuit shown in FIG. 1, the p-channel MOS transistors MP1 and MP2 constituting the input terminal of the differential amplifier OPA are different only in the value of the work function of the material used as the gate electrode G, so that a difference voltage corresponding to this difference in work function is multiplied by (Ra+Rb)/Ra at the resistor circuit RCT and appears as the output voltage VOUT at the output terminal OUT.

Since the p-channel MOS transistor MP1 is provided at its gate with the voltage of the higher-potential power supply VDD, its gate-source voltage is zero and, since the p-channel MOS transistor MP2 is provided at its gate with the difference voltage between the work function of the p-channel MOS transistor MP1 and that of p-channel MOS transistor MP2, these two MOS transistors have substantially the same electrical characteristics and temperature characteristics.

Therefore, even with power-supply voltage fluctuations or temperature changes, the output terminal OUT of the reference-voltage generating circuit shown in FIG. 1 is provided with an output voltage VOUT equal to the product of a difference voltage between the work function of the p-channel MOS transistor MP1 and that of the p-channel MOS transistor MP2, and (Ra+Rb)/Ra due to the resistor circuit RCT.

Also, if the difference in work function between the p-channel MOS transistors MP1 and MP2 is sufficiently large, a voltage which is equal to this difference in work function may be output as it is at the output terminal OUT with the resistance value of the resistor Rb of the resistor circuit RCT being zero (i.e., a highly conductive state).

Furthermore, since the p-channel MOS transistor MP1 is provided at its gate with the voltage of the higher-potential power supply VDD, the gate-source voltage is always zero, thus being stable even with fluctuations in the power-supply voltage.

Therefore, the p-channel MOS transistor MP1 acts as a constant-current circuit to keep the source-drain current at a constant level, so that the magnitude of the current flowing through the whole differential amplifier OPA is also kept always constant.

Moreover, the value of the work function of materials used as the gate electrode G is inherent to these materials, so that it is not affected by any fluctuations or variations through the fabrication processes.

With this, it is possible to provide a reference-voltage generating circuit that always generates a stable reference voltage.

Also, the work functionΦA of the material used as the gate electrode G of the p-channel MOS transistor MP1 is larger in potential, i.e. smaller in energy level, than the work functionΦB of the other material used as the gate electrode G of the p-channel MOS transistor MP2. In this case, however, the same effects can be obtained even if the work functions of the materials used as the gate electrodes of the p-channel MOS transistors MP1 and MP2 are as follows.

For example, there may be a case where the p-channel MOS transistors MP1 and MP2 have the same impurity concentration distribution of the channel region and also where the p-channel MOS transistor MP1 has its gate's Fermi level on the side of the valence band with respect to the intrinsic semiconductor's Fermi level and, at the same time, the p-channel MOS transistor MP2 has its gate's Fermi level on the side of the conduction band with respect to the intrinsic semiconductor's Fermi level.

There may also be a case where the p-channel MOS transistors MP1 and MP2 have the same impurity concentration distribution of the channel region and also where the p-channel MOS transistor MP1 has its gate's Fermi level on the side of the valence band with respect to the intrinsic semiconductor's Fermi level and, at the same time, the p-channel MOS transistor MP2 allows its gate's Fermi level to degenerate to the conduction band.

There may also be a case where the p-channel MOS transistors MP1 and MP2 have the same impurity concentration distribution of their channel regions and also where the p-channel MOS transistor MP1 allows its gate's Fermi level to degenerate to the valence band and, at the same time, the p-channel MOS transistor MP2 allows its gate's Fermi level to degenerate to the conduction band.

Specifically, the gate electrode of the p-channel MOS transistor MP1 may be formed with aluminum or a refractory metal such as molybdenum so that the Fermi level would be on the side of the valence band with respect to the intrinsic semiconductor's Fermi level, and the gate electrode of the p-channel MOS transistor MP2 may be formed with a high-concentration n-type silicon into which an impurity such as phosphorus or arsenic is doped at a concentration of approximately $10^{19}$ to $10^{23}$ $cm^{-3}$ so that its Fermi level degenerates to the conduction band.

Alternatively, the gate electrode of the p-channel MOS transistor MP1 may be formed with a high-concentration p-type silicon into which an impurity such as boron is doped at a concentration of approximately $10^{19}$ to $10^{20}$ $cm^{-3}$ so that its Fermi level degenerates to the valence band and the gate electrode of the p-channel MOS transistor MP2 may be formed with a high-concentration n-type silicon into which an impurity such as phosphorus or arsenic is doped at a concentration of approximately $10^{19}$ to $10^{20}$ $cm^{-3}$ so that its Fermi level degenerates to the conduction band.

That is, a reference-voltage generating circuit having the above-mentioned properties can be obtained in the case where the p-channel MOS transistors MP1 and MP2 have the same impurity concentration of their channel regions and, at the same time, the p-channel MOS transistor MP1 has a larger gate work function than that of the p-channel MOS transistor MP2.

Figure 3:
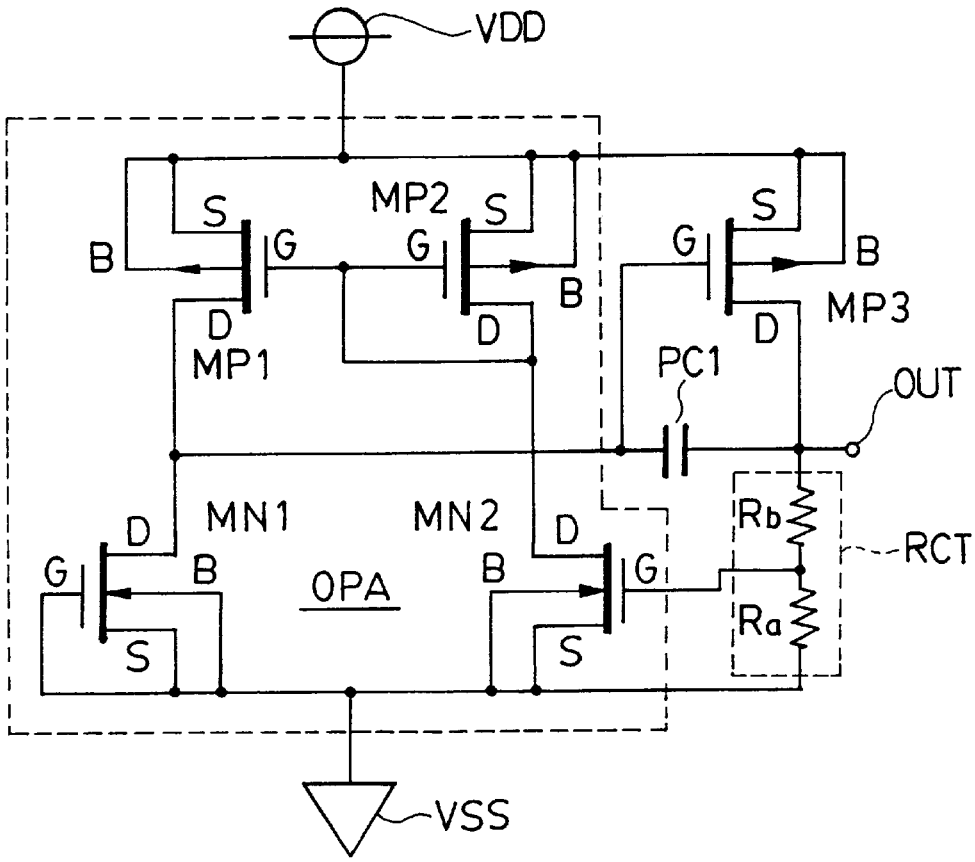
FIG. 3 is a circuit diagram showing the configuration of the reference-voltage generating circuit of the second embodiment of the present invention.
Figure 4:
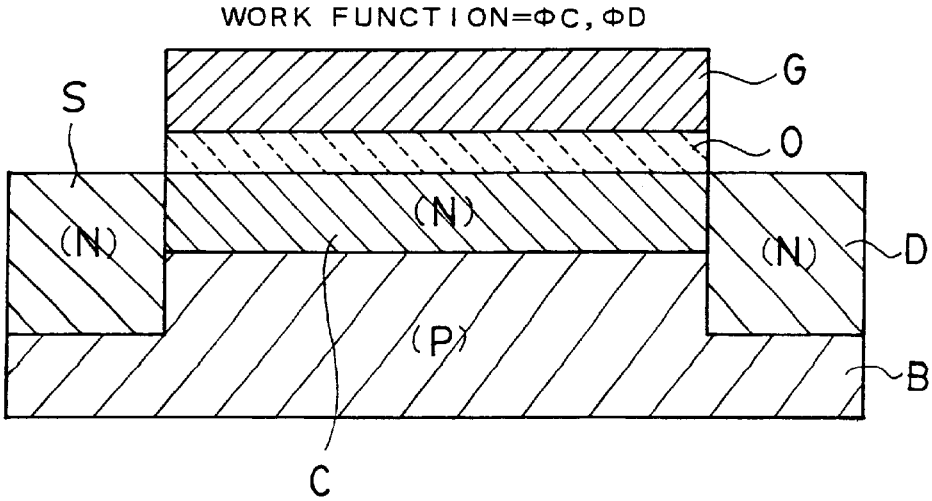
FIG. 4 is a schematic cross-sectional view showing the construction of p-channel MOS transistors used in the reference-voltage generating circuit of FIG. 3.

Second Embodiment: FIGS. 3 and 4

The following describes the second embodiment of the present invention with reference to FIG. 3. FIG. 3 is a circuit diagram showing the configuration of the concerned reference-voltage generating circuit.

The reference-voltage generating circuit shown in FIG. 3 comprises n-channel MOS transistors of the first conductivity type and p-channel MOS transistors of the second conductivity type.

Although the same reference numerals are applied, for convenience in description, to the circuit elements in FIG. 3 which correspond to those in the prior-art example shown in FIG. 1 and those in the reference-voltage generating circuit of the first embodiment shown in FIG. 1, it does not mean that those elements have the same configurations or properties.

In FIG. 3 also, the gate, the source, the drain, and the bulk of each MOS transistor are represented by G, S, D, and B respectively.

The reference-voltage generating circuit shown in FIG. 3 comprises the first, lower-potential power supply VSS and the second, higher-potential power supply VDD; the first and second n-channel MOS transistors MN1 and MN2 having the first conductivity type; the third, fourth, and fifth p-channel MOS transistors MP1, MP2, and MP3 having the second conductivity type; a resistor circuit RCT having resistors Ra and Rb connected in series; and an output terminal OUT at which a reference voltage appears.

In this reference-voltage generating circuit, the gate, source, and bulk of the n-channel MOS transistor MN1 and the source and bulk of the n-channel MOS transistor MN2 are connected to the lower-potential power supply VSS, while the drain of the n-channel MOS transistor MN1 is connected to the drain of the p-channel MOS transistor MP1 and the gate of the p-channel MOS transistor MP3.

Also, the drain of the n-channel MOS transistor MN2 is connected to the gate of the p-channel MOS transistor MP1 and the gate and drain of the p-channel MOS transistor MP2, while the sources and the bulks of the p-channel MOS transistors MP1, MP2, and MP3 are all connected to the higher-potential power supply VDD.

Moreover, the drain of the p-channel MOS transistor MP3 is connected to the output terminal OUT and also to the lower-potential power supply via the resistor circuit RCT, thus connecting the gate of the n-channel MOS transistor MN2 at the intermediate point of the resistor circuit RCT. Between the gate and the drain of the p-channel MOS transistor MN3, a phase compensation capacitor PC1 is connected for preventing oscillation, which, though, is not indispensable.

Out of those elements, the pair of n-channel MOS transistors MN1 and MN2 and the other pair of p-channel MOS transistors MP1 and MP2 constitute a differential amplifier OPA.

The above-mentioned n-channel MOS transistors MN1 and MN2 have substantially the same configuration except for mutually different work functions of the gate material, while the above-mentioned p-channel MOS transistors MP1 and MP2 have substantially the same properties.

Next, the construction of the above-mentioned n-channel MOS transistors MN1 and MN2 will be described with reference to FIG. 4.

FIG. 4 is a schematic cross-sectional view showing the construction of the n-channel MOS transistors used as the first and second MOS transistors.

These n-channel MOS transistors have their bulk region B formed with a low-concentration p-type semiconductor, their source region S and drain region D formed with a high-concentration n-type semiconductor in this bulk region, and their channel region formed with a low-concentration n-type semiconductor between the source region and the drain region.

Also, these n-channel MOS transistors have their gate electrode G formed with a metal or a semiconductor over the channel region C with an insulator film O therebetween, so that the gate electrode G, the source region S, the drain region D, and the bulk region B act as the gate, the source, the drain, and the bulk of each p-channel MOS transistor respectively.

The n-channel MOS transistors MN1 and MN2 in the second embodiment shown in FIG. 3 have substantially the same configuration (including materials and dimensions) as well as substantially the same impurity concentration distribution of the channel region C, except for mutually different work functions of the materials used as the gate electrode.

The work function ΦC of the material used as the gate electrode G of the n-channel MOS transistor MN1 is made smaller in potential, i.e. higher in energy level, than the work function ΦD of the other material used as the gate electrode G of the n-channel MOS transistor MN2.

Thus, to make the work functions of two gate electrodes G mutually different, it is necessary only to select and use two kinds of metals or semiconductors having different work functions. For example, aluminum or a refractory metal such as molybdenum and a high-concentration silicon can be selected in combination to provide mutually different work functions of the gate electrode.

However, in this case, large-or-small relation of work functions between the gate electrodes of the first MOS transistor (MN1) and the second MOS transistor (MN2) is reversed to the case in the above-mentioned first embodiment.

Next, the following explains the operation of the reference-voltage generating circuit shown in FIG. 3.

The p-channel MOS transistors MP1 and MP2 constituting a current mirror circuit of the differential amplifier OPA divide into two equal portions the current flowing through the differential amplifier OPA.

Therefore, the current flowing through the p-channel MOS transistor MP1 and the n-channel MOS transistor MN1 is always equal to the current flowing through the p-channel MOS transistor MP2 and the n-channel MOS transistor MN2.

The n-channel MOS transistors MN1 and MN2 should preferably be of the depletion type, such that a current may flow between the drain and the source even with the gate potential being zero. However, enhancement-type MOS transistors may also be used as far as even a slight current can flow between the drain and the source with the gate potential being zero.

Note here that since the n-channel MOS transistor MN1 employs a metal having a work function ΦC as its gate electrode G, it has a corresponding threshold voltage.

Similarly, since the n-channel MOS transistor MN2 employs a metal having a work function ΦD as its gate electrode G, it has a corresponding threshold voltage.

The difference between the threshold voltage of the of the n-channel MOS transistor MN1 and that of the n-channel MOS transistor MN2 is equal to the difference in work function of the gate electrode material between the n-channel MOS transistors MN1 and MN2.

Moreover, to provide a stable state for the differential amplifier OPA, the current flowing through the n-channel MOS transistor MN1 must be equal to the current flowing through the n-channel MOS transistor MN2.

In the configuration of the reference-voltage generating circuit shown in FIG. 3, the gate of the n-channel MOS transistor MN1 is connected to the lower-potential power supply VSS.

Therefore, the differential amplifier OPA will be stable only by applying to the gate of the n-channel MOS transistor MN2 the difference voltage between the threshold voltage of the n-channel MOS transistor MN1 and that of the n-channel MOS transistor MN2.

That is, the differential amplifier OPA will come into stability only by applying a feedback to its input terminal, i.e. the gate of the n-channel MOS transistor MN2, the difference voltage between the work function ΦC of the gate electrode G of the n-channel MOS transistor MN1 and the work function ΦD of the gate electrode of the n-channel MOS transistor MN2.

In the reference-voltage generating circuit, the n-channel MOS transistors MN1 and MN2 constituting the input terminal of the differential amplifier OPA are only different in the value of the work function of the material used as the gate electrode G, so that a difference voltage equal to this difference in work function is multiplied by (Ra+Rb)/Ra at the resistor circuit RCT and appears as the output voltage VOUT at the output terminal OUT.

Since the n-channel MOS transistor MN1 is provided at its gate with the voltage of the lower-potential power supply VSS, its gate-source voltage is zero and, since the n-channel MOS transistor MN2 is provided at its gate with a voltage which is equal to the difference between the work function of the n-channel MOS transistor MN1 and that of the n-channel MOS transistor MN2, these two MOS transistors have substantially the same electrical characteristics and temperature characteristics.

Thus, the n-channel MOS transistor MN1 is provided at its gate with the voltage of the lower-potential power supply VSS, so that its gate-source voltage is always zero, not being affected by possible fluctuations in the power supply voltage.

Therefore, the n-channel MOS transistor MN1 acts as a constant-current circuit to keep the source-drain current at a constant level, so that the current flowing through the whole differential amplifier OPA is always kept constant.

Therefore, even with the power supply voltage fluctuations or temperature changes, the output terminal OUT of the reference-voltage generating circuit is provided with an output voltage VOUT equal to the product of a difference voltage between the work function of the n-channel MOS transistor MN1 and that of the n-channel MOS transistor MN2, and (Ra+Rb)/Ra due to the resistor circuit RCT.

Also, if the difference in work function between the n-channel MOS transistors MN1 and MN2 is sufficiently large, a voltage which is equal to this difference in work function may be output as it is at the output terminal OUT with the resistance value of the resistor Rb of the resistor circuit RCT being zero (i.e., a highly conductive state).

Moreover, the value of the work function of materials used as the gate electrodes G is inherent to these materials, so that it is not affected by any fluctuations or variations through the fabrication processes.

With this, it is possible to provide a reference-voltage generating circuit that always generates a stable reference voltage.

Also, the work function ΦC of the material used as the gate electrode G of the n-channel MOS transistor MN1 is smaller in potential, i.e. higher in energy level, than the work function ΦC of the other material used as the gate electrode G of the n-channel MOS transistor MN2. In this case, however, the same effects can be obtained even if the work functions of the materials used as the gate electrodes of the n-channel MOS transistors MN1 and MN2 are as follows.

For example, there may be a case where the n-channel MOS transistors MN1 and MN2 have the same impurity concentration distribution of the channel region and also where the n-channel MOS transistor MN1 has its gate's Fermi level on the side of the conduction band with respect to the intrinsic semiconductor's Fermi level and, at the same time, the n-channel MOS transistor MN2 has its gate's Fermi level on the side of the valence band with respect to the intrinsic semiconductor's Fermi level.

There may also be a case where the n-channel MOS transistors MN1 and MN2 have the same impurity concentration distribution of the channel region and also where the n-channel MOS transistor MN2 allows its gate's Fermi level to degenerate to the conduction band and, at the same time, the n-channel MOS transistor MN2 has its gate's Fermi level on the side of the valence band with respect to the intrinsic semiconductor's Fermi level.

There may also be a case where the n-channel MOS transistors MN1 and MN2 have the same impurity concentration distributions of the channel region and also where the n-channel MOS transistor MN1 allows its gate's Fermi level to degenerate to the conduction band and, at the same time, the n-channel MOS transistor MN2 allows its gate's Fermi level to degenerate to the valence band.

Specifically, the gate electrode of the n-channel MOS transistor MN1 may be formed with a high-concentration n-type silicon into which an impurity such as phosphorus or arsenic is doped at a concentration of approximately $10^{19}$ to $10^{20}$ $cm^{-3}$ so that its Fermi level degenerates to the conduction band, and the gate electrode of the n-channel MOS transistor MN2 may be formed with aluminum or a refractory metal such as molybdenum Fermi level of which is on the side of the valence band with respect to the Fermi level of the intrinsic semiconductor. Alternatively, the gate electrode of the n-channel MOS transistor MN1 may be formed with a high-concentration n-type silicon in which an impurity such as phosphorus or arsenic is doped at a concentration of approximately $10^{19}$ to $10^{20}$ $cm^{-3}$ so that its Fermi level degenerates to the conduction band, and the gate electrode of the n-channel MOS transistor MN2 may be formed with a high-concentration p-type silicon in which an impurity such as boron is doped at a concentration of approximately $10^{19}$ to $10^{20}$ $cm^{-3}$ so that its Fermi level degenerates to the valence band.

That is, a reference-voltage generating circuit having the above-mentioned properties can be obtained in the case where the n-channel MOS transistors MN1 and MN2 have the same impurity concentration distributions of the channel region and, at the same time, the n-channel MOS transistor has a smaller work function of the gate electrode than that of the n-channel MOS transistor MN2.

As has been described above, a reference-voltage generating circuit according to the present invention outputs as the reference voltage a voltage which is equal to or proportional to a difference in work functions of the gate electrodes between the two MOS transistors of the same conductivity type constituting the input terminal of a differential amplifier provided between the first and the second power supply, so that it can generate a stable reference voltage, not being affected by power supply voltage fluctuations and temperature changes nor by fluctuations or variations through fabrication processes.

What is claimed is:

1. A reference-voltage generating circuit comprising a first and a second power supply having mutually different power-supply potentials, a first and a second MOS transistor of a first conductivity type, a third, a fourth, and a fifth MOS transistor of a second conductivity type, a resistor circuit, and an output terminal at which a reference voltage appears, wherein a gate, source, and bulk of said first MOS transistor and a source and bulk of said second MOS transistor are connected to said first power supply;

a drain of said first MOS transistor is connected to a drain of said third MOS transistor and a gate of said fifth MOS transistor;

a drain of said second MOS transistor is connected to a gate of said third MOS transistor and a gate and drain of said fourth MOS transistor;

sources and bulks of said third, fourth, and fifth MOS transistors all are connected to said second power supply;

the drain of said fifth MOS transistor is connected to said output terminal and, at the same time, is connected to said first power supply via said resistor circuit;

the gate of said second MOS transistor is connected to an intermediate point of said resistor circuit;

said first MOS transistor and said second MOS transistor have substantially the same configurations except for mutually different work functions of the gate material; and said third MOS transistor and said fourth MOS transistor have substantially the same properties.

2. The reference-voltage generating circuit of claim 1, wherein said first and second MOS transistors of the first conductivity type are p-channel type;

said second, third, and fourth MOS transistors of the second conductivity type are n-channel type; and said first MOS transistor has a larger gate work function than said second MOS transistor.

3. The reference-voltage generating circuit of claim 2, wherein the gate of said first MOS transistor is formed with a high-concentration p-type silicon so that the Fermi level degenerates to the valence band; and the gate of said second MOS transistor is formed with a high-concentration n-type silicon so that the Fermi level degenerates to the conduction band.

4. The reference-voltage generating circuit of claim 1, wherein said first and second MOS transistors of the first conductivity type are n-channel type;

said third and fourth MOS transistors of the second conductivity type are p-channel type; and said first MOS transistor has a smaller gate work function than said second MOS transistor.

5. The reference-voltage generating circuit of claim 4, wherein the gate of said first MOS transistor is formed with a high-concentration n-type silicon so that the Fermi level degenerates to the conduction band; and the gate of said second MOS transistor is formed with a high-concentration p-type silicon so that the Fermi level degenerates to the valence band.

* * * * *